US005392494A

United States Patent [19]

Wronski

[11] Patent Number: 5,392,494

[45] Date of Patent: Feb. 28, 1995

[54] WINDOW STAY

[75] Inventor: Yurek A. Wronski, Cheltenham, United Kingdom

[73] Assignee: Cotswold Architectural Products Limited, Cheltenham, United Kingdom

[21] Appl. No.: 55,302

[22] Filed: May 3, 1993

[30] Foreign Application Priority Data

Feb. 19, 1993 [GB] United Kingdom ..... 9303328

[51] Int. Cl.[6] ..... E05D 7/12

[52] U.S. Cl. ..... 16/364; 16/380; 16/DIG. 40; 16/270; 49/339; 403/161; 403/326

[58] Field of Search ..... 49/339, 252, 246; 403/68, 54, 154, 78, 157, 375, 161, 381, 309, 326; 16/362, 270, 380, DIG. 34, DIG. 40, 93 R, 364, 366, 370, 261, 265

[56] References Cited

U.S. PATENT DOCUMENTS

| | | | |
|---|---|---|---|
| 1,753,703 | 4/1930 | Haskins | 49/346 |
| 3,457,675 | 7/1969 | Armstrong . | |
| 3,591,216 | 7/1971 | Onufer | 403/161 |
| 3,984,191 | 10/1976 | Doty | 403/155 |
| 4,137,603 | 2/1979 | Kvasnes . | |
| 4,352,586 | 10/1982 | Hayden | 403/375 |
| 4,593,431 | 6/1986 | Sandberg et al. | 16/381 |
| 4,790,106 | 12/1988 | LaSee | 49/252 |
| 4,833,754 | 5/1989 | Yang | 49/252 |
| 5,237,723 | 8/1993 | Little | 16/261 |

FOREIGN PATENT DOCUMENTS 1234040 6/1971 United Kingdom .

*Primary Examiner*—Lowell A. Larson
*Assistant Examiner*—Donald M. Gurley
*Attorney, Agent, or Firm*—Young & Thompson

[57] ABSTRACT

A stay generally indicated at 10 comprises a base 11, a window support 12 and a link 13. The link 13 is releasably and pivotally connected at 20 to the base 11. The connection at 20 is formed between a projection 22 and an end cap 23, which defines a through passage 25 for receiving the projection 22. The end cap 23 has an annular projection 26 which is dimensioned to snap fit into a circular groove 27 in the projection 22.

10 Claims, 3 Drawing Sheets

WINDOW STAY

FIELD OF THE INVENTION

This invention relates to window stays or hinges.

BACKGROUND OF THE INVENTION

It is known, particularly in the United States, to supply such stays in a form whereby the links and arms of the stay are mounted on the window and the base of the stay is mounted on the window frame. The frame is located and secured in the building and the builder then presents the window into the frame and slides a slider into a channel on the base. He then secures one of the links to the base using some form of releasable attachment. Examples of such attachments are illustrated in U.S. Pat. Nos. 3,457,675 and 4,593,431. That shown in the first of these Patents comprises a locking device slidably mounted on the link which engages in a recess of an upstanding stud on the base. While this works in principle, it is quite expensive to manufacture and assemble and is susceptible to damage during transit or jamming if not used for a long period of time. In this latter connection, it should be understood, that many of these stays are manufactured with a view to a short life expectancy and it is anticipated that the stay will require subsequent release to allow for repair or retro re-fitting.

In U.S. Pat. No. 4,593,431 the releasable connection is provided by a circular circlip which sits in an expanded position in a recess in a stud to hold the link to the base but which can be compressed into that recess when the link is subjected to a force which makes it travel longitudinally with respect to the stud. Here the circlip can come off the stud or it may become jammed as grease and dirt build up in the recess. Manufacture is also once again quite expensive.

SUMMARY OF THE INVENTION

The present invention provides a stay having a base defining a channel, slideable means mounted in the channel for sliding movement with respect to the base, a window support arm pivotally connected to the slider means and link means mounted at one end to the arm and on the other end, by releasable connecting means, to the base, wherein the releasable connection means comprises a stud like projection on the base and a cap on the link defining, with the link, a passage for receiving the projection, the projection and the cap having engageable cooperating snap-fitting formations to hold releasably the projection within the passage.

The formation on the cap may be located within the passage and it may be deflectable in response to relative axial movement between the projection and the passage. The formation of the cap may be in the form of a generally annular projection extending at least substantially around the passage. The formation on the projection may be a recess and conveniently is in the form of a circular circumferential groove.

The cap may be made of plastics material and it may extend to either side of the link means. The cap may provide a bearing surface between the link and arm and/or base. Additionally or alternatively the cap may provide a bearing surface between the link means and the projection.

The cap may be a push fit on the end of the link means.

Although the invention has been defined above it is to be understood that it consists in any inventive combination of the features set out above or in the following description.

BRIEF DESCRIPTION OF THE DRAWINGS

The invention may be performed in various ways and a specific embodiment will now be described, by way of example, with reference to the accompanying drawings, in which.

DETAILED DESCRIPTION OF THE INVENTION

Figure 1:
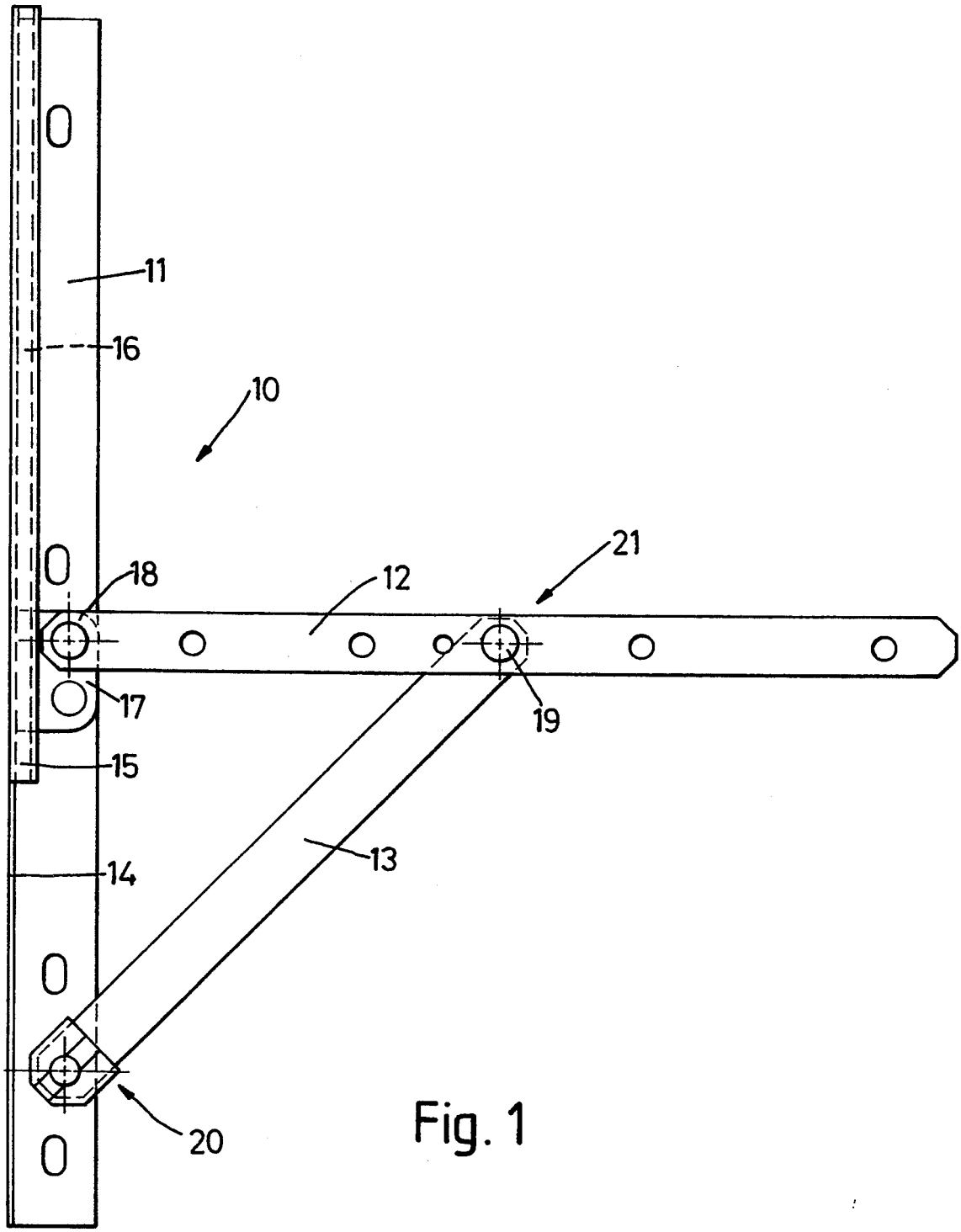
FIG. 1 is a view from above of a window stay in its open position.
Figure 2:
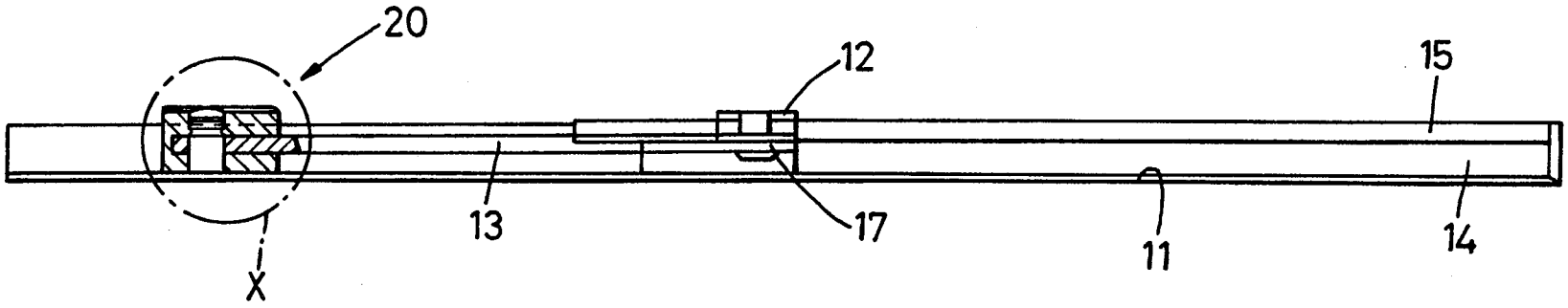
FIG. 2 is a side view of the stay of FIG. 1.

A stay generally indicated at 10 comprises a base 11, a window support arm 12 and a link 13. The base 11 has an upstanding wall 14 with a turned over lip 15 extending along part of its length to define a channel 16 which receives a slider 17 on which one end 18 of the arm 12 is pivotally mounted. The link 13 is pivotally connected at 19 to the arm 12 and at 20 to the base 11. This latter connection is releasable.

It will be seen that the arm and link assembly, generally indicated at 21, can thus be mounted on a base 11, which is already affixed to a window frame, by first introducing the slider 17 into the channel 16 and then connecting the link 13 to the base 11 at 20.

Figure 3:
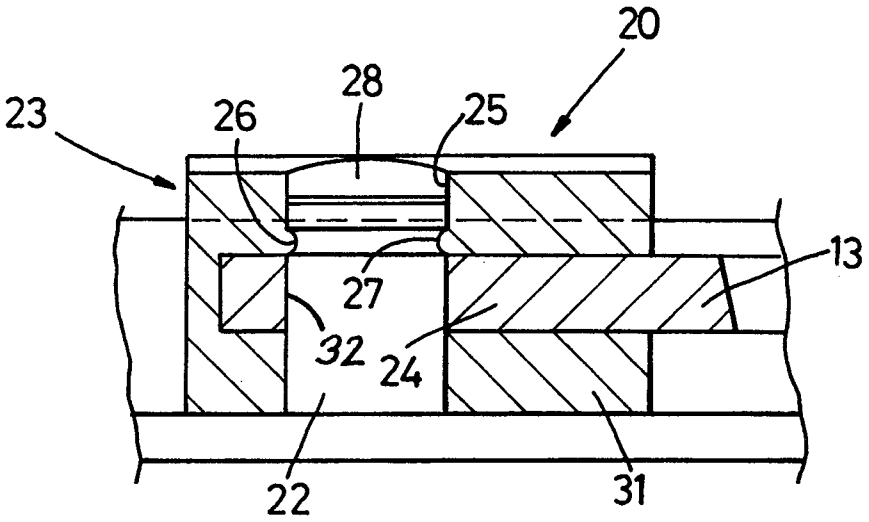
FIG. 3 is an enlarged view at X in FIG. 2.
Figure 4:
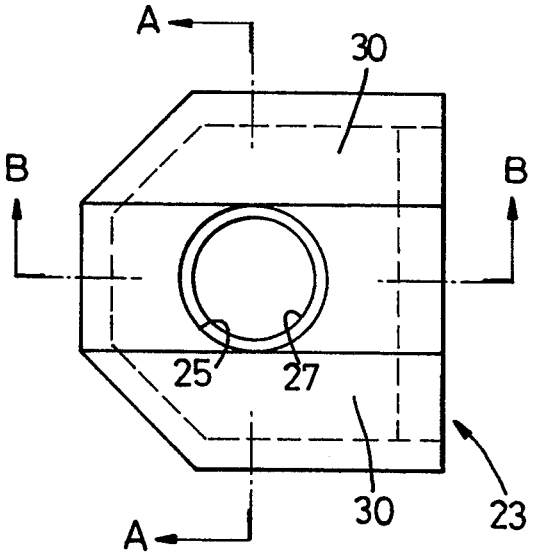
FIG. 4 is an enlarged plan view of an end cap of the stay and FIG. 1.
Figure 5:
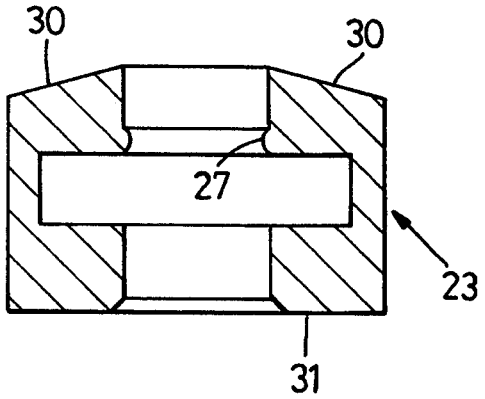
FIG. 5 is a section along the line AA of FIG. 4.
Figure 6:
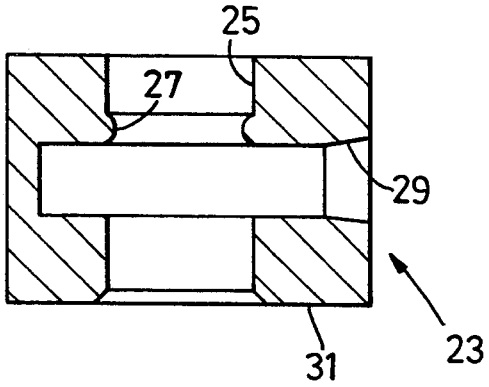
FIG. 6 is a section along the line BB of FIG. 4.

As so far described in the two immediately preceding paragraphs, such an arrangement is entirely conventional. What is not conventional is the manner in which the releasable connection at 20 is achieved. Thus, as can best be seen in FIG. 3, the connection at 20 is formed between an upstanding stud-like projection 22 and an end cap 23 which is a push fit on the end 24 of the link 13. Together with the link 13, this end cap 23 defines a through passage 25 which is dimensioned to receive the projection 22. Just above the link 13, the end cap 23 is provided with an annular projection 26 which is dimensioned to snap fit into a circular groove 27 formed circumferentially in the stud-like projection 22.

Thus, in use, as the passage 25 is pushed past the stud-like projection 22, the head 28 initially deflects the projection 26 so that it rides down the side of the stud-like projection 22 and then snaps into the groove 27 locking the link 13 to the projection 22 and hence the base 11. It will be noted that the annular projection 26 is radiused so that if, later, the end 24 of the link 13 is lifted away from the base 11, for example by levering the link with a screwdriver, then the projection 26 will cam out of the groove 27 releasing the link 13 from the base 11.

The end cap 23 is preferably formed of plastics material and this has a number of advantages. First it is easy and cheap to form, secondly it can be made in a single unit with both the passage 25 for the projection 22 and a lateral opening 29 for the end 24 of the link 13 and thirdly the upper surface 30 can be inclined, so that the end cap provides a bearing surface for the arm 12 and lifts it clear of the link 13 on closing so as to prevent binding. Further the base 31 of the cap 23 can provide a low friction engagement with the base 11 while also providing good stability around the pivot point. Finally it would be possible to form the opening 32 in the link 13 slightly oversized so that there was in fact no metal-to-metal contact between the link 13 and the projection 26.

Figure 7:
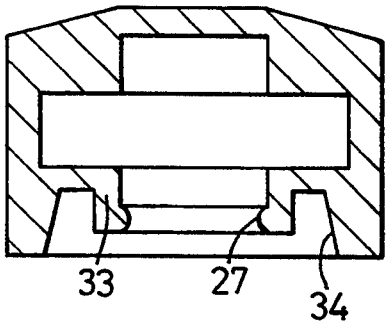
FIG. 7 is a section corresponding to that of FIG. 5 through an alternative form of end cap.

It would of course be equally feasible to form the annular projection on the stud-like projection 22 and have a corresponding groove on the end cap 23. However this is less preferred where the stud-like projection is made of metal, because it is less simply formed. In another embodiment the annular projection and the groove may be located beneath the level of the link 13 in the assembled position. Thus as can be seen in FIG. 7 the projection 27 may be formed on a dependent skirt 33, defined by an opening 34 in the base 31, which allows for ready lateral flexing. It will be appreciated that the projection 27 need not be continuous.

If it is desired to provide particularly good dust and grease protection for the interengagement the end cap 23 may be formed to close off the upper end for the passage 25 as, for example, in FIG. 7.

What I claim is:

1. A stay having a base defining a channel, slider means mounted in the channel for sliding movement with respect to the base, a window support arm pivotally connected to the slider means and link means pivotally connected at one end to the arm and at the other end, by releasable connecting means, to the base wherein the releasable connecting means comprises a stud like projection on the base and a cap on the link, defining with the link, a passage for receiving the projection, the projection and cap having engageable cooperating snap-fit formations to hold releasably the projection within the passage.

2. A stay as claimed in claim 1 wherein the formation on the cap is located within the passage.

3. A stay as claimed in claim 1 wherein the formation on the cap is deflectable in response to relative axial movement between the projection and the passage.

4. A stay as claimed in claim 1 wherein the formation on the cap is in the form of a generally annular projection extending at least substantially around the passage.

5. A stay as claimed in claim 1 wherein the formation on the projection is a recess.

6. A stay as claimed in claim 1 wherein the cap is made of plastics material.

7. A stay as claimed in claim 1 wherein the cap extends on both sides of the link means.

8. A stay as claimed in claim 1 wherein the cap provides a bearing surface between the link and arm and/or the link and base.

9. A stay as claimed in claim 1 wherein the cap provides a bearing surface between the link means and projection.

10. A stay as claimed in claim 1 wherein the cap is a push-fit on the other end of the link means.

* * * * *